US010783871B2

(12) United States Patent
Norris et al.

(10) Patent No.: US 10,783,871 B2
(45) Date of Patent: Sep. 22, 2020

(54) METAL ACOUSTIC LENS AND METHOD OF MANUFACTURING SAME

(71) Applicant: Rutgers, The State University of New Jersey, New Brunswick, NJ (US)

(72) Inventors: Andrew N. Norris, Mountainside, NJ (US); Xiaoshi Su, Manalapan, NJ (US)

(73) Assignee: RUTGERS, THE STATE UNIVERSITY OF NEW JERSEY, New Brunswick, NJ (US)

( * ) Notice: Subject to any disclaimer, the term of this patent is extended or adjusted under 35 U.S.C. 154(b) by 365 days.

(21) Appl. No.: 15/724,812

(22) Filed: Oct. 4, 2017

(65) Prior Publication Data

US 2018/0286379 A1 Oct. 4, 2018

Related U.S. Application Data

(60) Provisional application No. 62/404,024, filed on Oct. 4, 2016.

(51) Int. Cl.

| | |
|---|---|
| ***G10K 11/30*** | (2006.01) |
| *G10K 11/26* | (2006.01) |
| *G10K 11/18* | (2006.01) |

(52) U.S. Cl.

CPC ..... *G10K 11/30* (2013.01)

(58) Field of Classification Search

CPC ..... G10K 11/30; G10K 11/26; G10K 11/18; G10K 11/205; B32B 3/12; E04B 2001/748; E04B 2001/848

See application file for complete search history.

(56) References Cited

U.S. PATENT DOCUMENTS

| | | | | | |
|---|---|---|---|---|---|
| 2,684,724 | A * | 7/1954 | Kock | H01Q 15/02 | 181/176 |
| 3,699,481 | A * | 10/1972 | Thompson | E04B 1/86 | 333/145 |
| 5,504,718 | A * | 4/1996 | Gaynor | H01Q 19/026 | 367/138 |
| 9,437,184 | B1 * | 9/2016 | Swett | G10K 11/30 | |
| 9,581,715 | B1 * | 2/2017 | Swett | G01V 1/52 | |
| 9,640,170 | B2 * | 5/2017 | Cipolla | G10K 11/18 | |
| 9,952,343 | B2 * | 4/2018 | Swett | G01V 1/52 | |
| 10,054,707 | B2 * | 8/2018 | Swett | E21B 47/0005 | |
| 10,468,011 | B2 * | 11/2019 | Ahn | G10K 11/162 | |
| 2013/0025961 | A1 * | 1/2013 | Koh | F16F 15/02 | 181/207 |
| 2014/0126322 | A1 * | 5/2014 | Cipolla | G10K 11/18 | 367/1 |

* cited by examiner

*Primary Examiner* — Edgardo San Martin
(74) *Attorney, Agent, or Firm* — Fox Rothschild LLP

(57) ABSTRACT

A metal acoustic lens comprises a plurality of stacked plates, wherein each plate comprises an acoustically transparent two-dimensional material structure comprising a plurality of adjacent regular hexagonal cells, wherein each hexagonal cell includes a plurality of lobes extending inwardly from the vertices of the hexagonal cell, and wherein the lengths of the lobes vary across each plate in the longitudinal direction such that the speed of sound waves passing therethrough is varied and the resulting sound is focused.

18 Claims, 15 Drawing Sheets
(11 of 15 Drawing Sheet(s) Filed in Color)

FIG. 16A
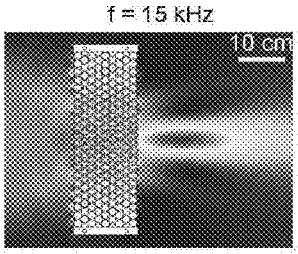
FIG. 16B
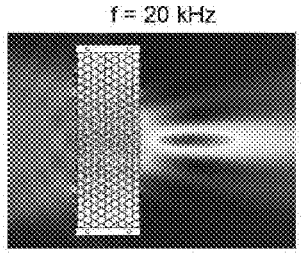
FIG. 16C
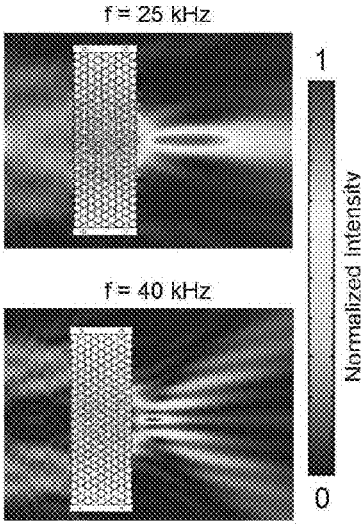
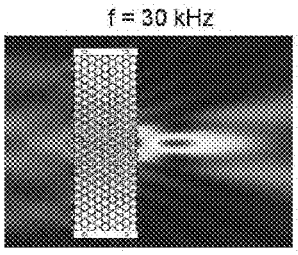
FIG. 16D
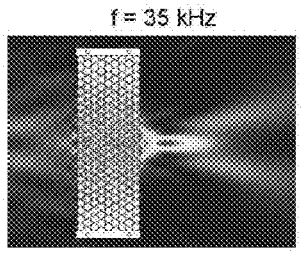
FIG. 16E
FIG. 16F
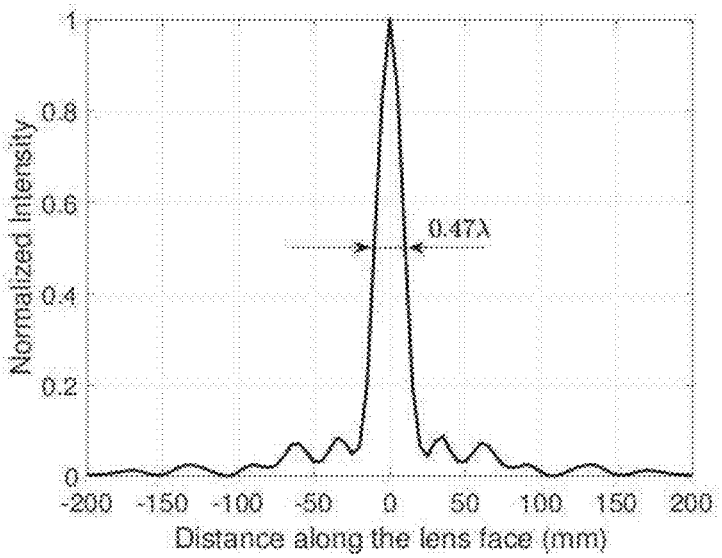
FIG. 17

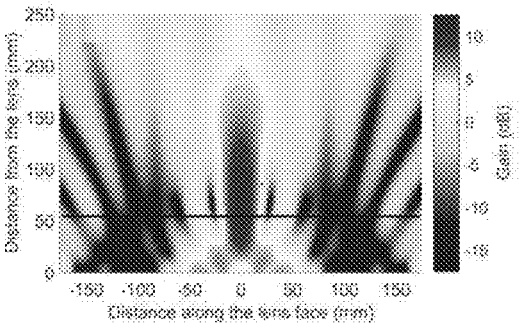
FIG. 18A
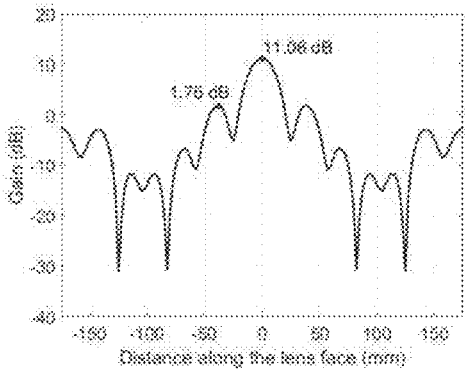
FIG. 18B
FIG. 19A
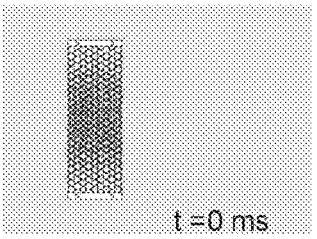
FIG. 19B
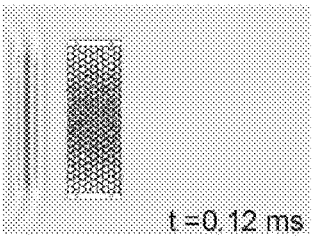
FIG. 19C
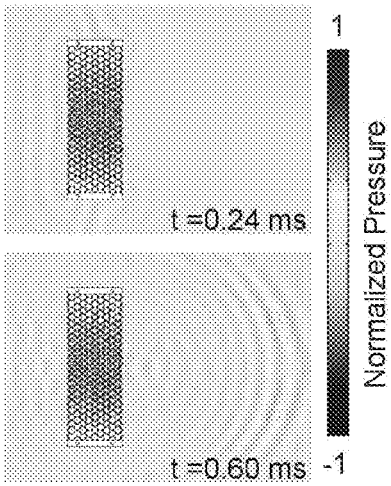
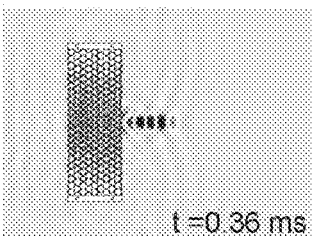
FIG. 19D
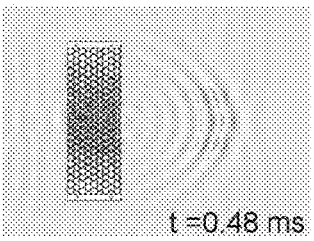
FIG. 19E
FIG. 19F FIG. 22A
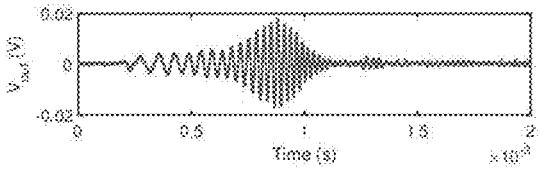
FIG. 22B
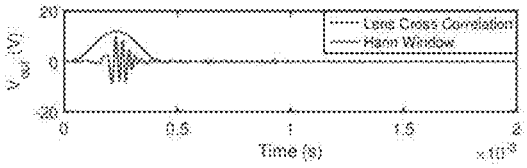
FIG. 22C
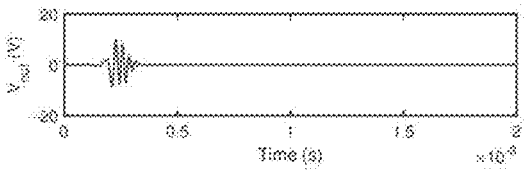
FIG. 23A FIG. 23B FIG. 23C
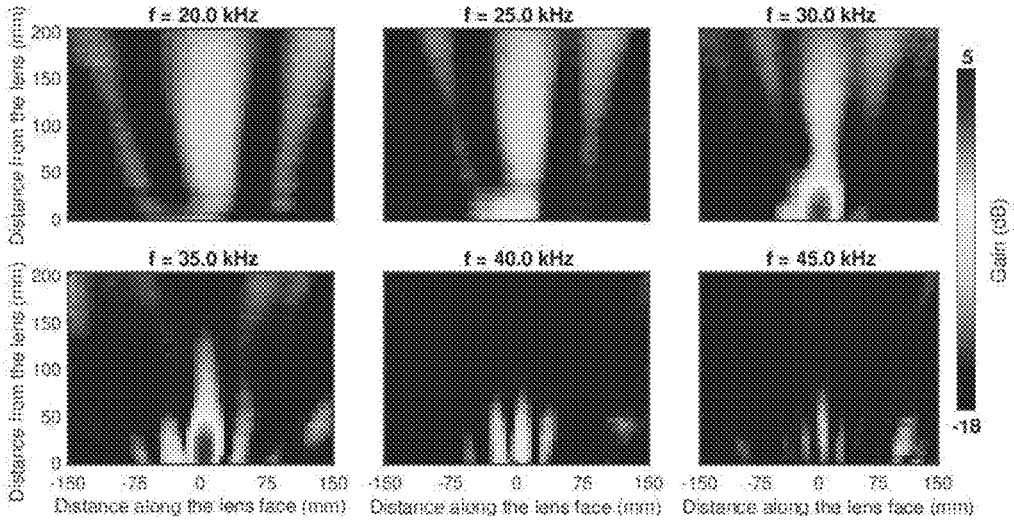
FIG. 23D FIG. 23E FIG. 23F

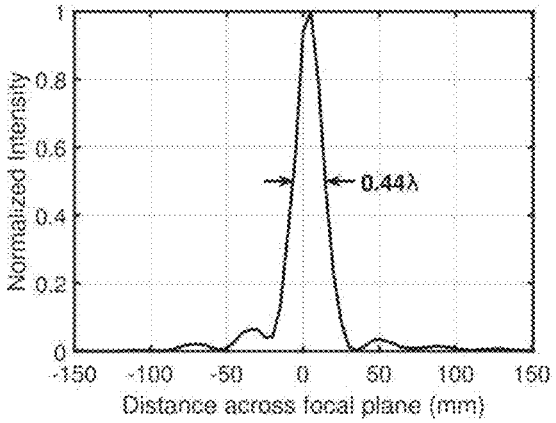
FIG. 24
FIG. 25A
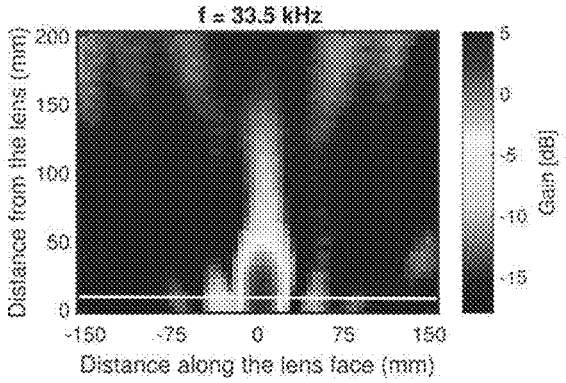
FIG. 25B
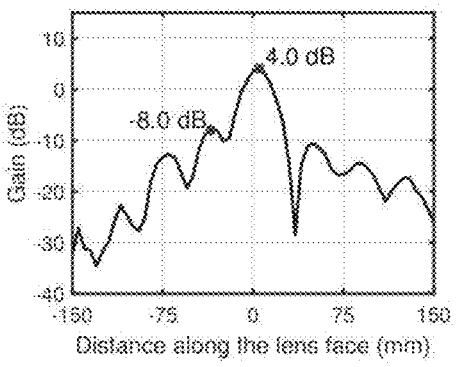

METAL ACOUSTIC LENS AND METHOD OF MANUFACTURING SAME

CROSS-REFERENCE TO RELATED APPLICATIONS

This application claims the benefit of provisional U.S. Patent Application No. 62/404,024 filed on Oct. 4, 2016, which is incorporated herein by reference in its entirety. This application is related to U.S. patent application Ser. No. 13/464,385 filed on May 4, 2012, which is incorporated herein by reference in its entirety.

STATEMENT OF GOVERNMENT LICENSE RIGHTS

The present invention was made with government support under grant number N00014-13-1-0631 awarded by the Office of Naval Research, U.S. Department of Defense. The United States government may have certain rights in this invention.

TECHNICAL FIELD

This disclosure relates generally to the fields of material sciences and a metal acoustic lens, and more specifically, to materials which mimic the acoustic behavior of water and methods of use thereof for a metal acoustic lens and other applications.

BACKGROUND

Acoustic metamaterials are artificially fabricated materials designed to control, direct, and manipulate sound in the form of sonic, or ultrasonic waves, as these might occur in gases, liquids, and solids. Control of the various forms of sound waves is mostly accomplished through manipulation of the bulk modulus β, and mass density p. The density and bulk modulus are analogies of the electromagnetic parameters, permittivity and permeability, respectively, in electromagnetic metamaterials. Related to this is the mechanics of wave propagation in a lattice structure. Also, materials have mass and intrinsic degrees of stiffness. Together, these form a dynamic system, and the mechanical (sonic) wave dynamics may be excited by appropriate sonic frequencies (for example, pulses at audio frequencies).

Acoustic energy propagation in water depends on two material parameters: the density (approximately 1000 $kg/m^3$) and the bulk modulus (approximately 2.25 Gigapascals) resulting in a fixed speed of sound (approximately 1500 m/s). It is also characterized by its extremely low rigidity, close to zero, which manifests itself in the inability of water to sustain shear waves. The development of a material that could mimic these properties is desirable.

SUMMARY OF THE DISCLOSURE

The disclosure is directed to an acoustic metamaterial lens based on a spatial variation of refractive index for broadband focusing of underwater sound. The index gradient follows a modified hyperbolic secant profile designed to reduce aberration and suppress side lobes.

An exemplary embodiment of the gradient index (GRIN) lens of the invention is comprised of transversely isotropic hexagonal unit cells with tunable quasi-static bulk modulus and mass density. Therein, the unit cells are impedance-matched to water and have in-plane shear modulus that is negligible compared to the effective bulk modulus. The plates of an exemplary embodiment of the GRIN lens of the invention can be fabricated by cutting hexagonal centimeter scale hollow microstructures in aluminum plates, which are then stacked and sealed from the exterior water.

In an exemplary embodiment, a metal acoustic lens comprises a plurality of stacked plates and cover plates on the top and bottom of the plurality of stacked plates, wherein each stacked plate comprises an acoustically transparent two-dimensional material structure comprising: a plurality of adjacent hexagonal cells, wherein each hexagonal cell includes six members which form the sides of the hexagonal cell, and a plurality of lobes extending inwardly from the vertices of the hexagonal cell; wherein the lengths and widths of the lobes vary across each stacked plate in the longitudinal direction and the lengths and widths of the members vary across each stacked plate in the longitudinal direction such that the speed of sound waves passing therethrough is varied and the resulting sound is focused.

In another exemplary embodiment of the metal acoustic lens, the plurality of adjacent hexagonal cells have an acoustic impedance that is equal to the acoustic impedance for water.

In a further exemplary embodiment of the metal acoustic lens, the plurality of adjacent hexagonal cells are transversely isotropic; and the lens has an index of refraction gradient that follows a modified hyperbolic secant profile, and the index of refraction values within the lens are in the range of 0.5 to 1.0.

In another exemplary embodiment, a plate comprises an acoustically transparent two-dimensional material structure, the acoustically transparent two-dimensional material structure comprising: a plurality of adjacent hexagonal cells, wherein each hexagonal cell includes six members which form the sides of the hexagonal cell, and a plurality of lobes extending inwardly from the vertices of the hexagonal cell; wherein the lengths and widths of the lobes vary across each plate in the longitudinal direction and the lengths and widths of the members vary across each plate in the longitudinal direction such that the speed of sound waves passing therethrough is varied and the resulting sound is focused.

In another exemplary embodiment of the plate, the plurality of adjacent hexagonal cells have an acoustic impedance that is equal to the acoustic impedance for water.

In a further exemplary embodiment of the plate, the plurality of adjacent hexagonal cells are transversely isotropic.

Another exemplary embodiment of the invention includes a method of manufacturing a plate comprising an acoustically transparent two-dimensional material structure. The method comprises: machining out of a solid piece of metal a plurality of adjacent hexagonal cells, wherein each hexagonal cell includes six members which form the sides of the hexagonal cell, and a plurality of lobes extending inwardly from the vertices of the hexagonal cell; wherein the lengths and widths of the lobes vary across each plate in the longitudinal direction and the lengths and widths of the members vary across each plate in the longitudinal direction such that the speed of sound waves passing therethrough is varied and the resulting sound is focused.

In another exemplary embodiment of the method of manufacturing a plate, the plurality of adjacent hexagonal cells have an acoustic impedance that is equal to the acoustic impedance for water.

In a further exemplary embodiment of the method of manufacturing a plate, the plurality of adjacent hexagonal cells are transversely isotropic.

Another exemplary embodiment of the invention includes a method of manufacturing a metal acoustic lens. The method comprises: manufacturing a plurality of plates comprising an acoustically transparent two-dimensional material structure. The method of manufacturing the plates comprising: machining out of a solid piece of metal a plurality of adjacent hexagonal cells, wherein each hexagonal cell includes six members which form the sides of the hexagonal cell, and a plurality of lobes extending inwardly from the vertices of the hexagonal cell; wherein the lengths and widths of the lobes vary across each plate in the longitudinal direction and the lengths and widths of the members vary across each plate in the longitudinal direction such that the speed of sound waves passing therethrough is varied and the resulting sound is focused. Then, the method of manufacturing a metal acoustic lens further comprises stacking the plurality of plates on top of each other, and including a gasket placed between each pair of plates; affixing cover plates on the top and bottom of the stack of the plurality of plates; and aligning the stack of the plurality of plates by inserting a plurality of rods through the stack of the plurality of plates.

In another exemplary embodiment of the method of manufacturing a metal acoustic lens, the plurality of adjacent hexagonal cells have an acoustic impedance that is equal to the acoustic impedance for water.

In a further exemplary embodiment of the method of manufacturing a metal acoustic lens, the plurality of adjacent hexagonal cells are transversely isotropic; and the lens has an index of refraction gradient that follows a modified hyperbolic secant profile, and the index of refraction values within the lens are in the range of 0.5 to 1.0.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 16A, FIG. 16B, FIG. 16C, FIG. 16D, FIG. 16E and FIG. 16F shows simulation results for a plane wave normally incident from the left side of an exemplary embodiment of the lens of the present invention. Plots FIG. 16A through FIG. 16F show the normalized steady state intensity at 15 kHz, 20 kHz, 25 kHz, 30 kHz, 35 kHz and 40 kHz, respectively.

FIG. 17 shows the focusing capability at 35 kHz of an exemplary embodiment of the lens of the present invention. The plot shows the simulated normalized intensity along the direction parallel to the lens face and through the focal point.

FIG. 18A and FIG. 18B shows a simulated sound pressure level gain (dB) at 33.5 kHz for an exemplary embodiment of the lens of the present invention. The gain in the focal plane is shown in FIG. 18A, and the gain through the focal point along the horizontal line from FIG. 18A is shown in FIG. 18B.

FIG. 19A, FIG. 19B, FIG. 19C, FIG. 19D, FIG. 19E and FIG. 19F shows a simulated transient pressure wave propagation at 30 kHz for an exemplary embodiment of the lens of the present invention. The six figures FIG. 19A through FIG. 19F correspond to times of 0 ms, 0.12 ms, 0.24 ms, 0.36 ms, 0.48 ms and 0.60 ms, respectively. The pressure is normalized to the maximum at t=0.36 ms.

FIG. 22A shows a raw hydrophone voltage signal for an exemplary embodiment of the lens of the present invention. The hydrophone signal cross correlated with the input signal is shown in FIG. 22B with the blue curve (i.e., the squiggly line). Applying the red window function results in the signal shown in FIG. 22C. The window function amplitude has been exaggerated to better pictorially represent where it is applied.

FIG. 23A, FIG. 23B, FIG. 23C, FIG. 23D, FIG. 23E and FIG. 23F shows plots of the gain (dB) exhibited due to the inclusion of an exemplary embodiment of the lens of the present invention. The plots are oriented from a top-view orientation of the entire scan area, and each plot is of a single frequency. The six plots FIG. 23A through FIG. 23F correspond to frequencies of 20 kHz, 25 kHz, 30 kHz, 35 kHz, 40 kHz and 45 kHz, respectively. The plots have been rotated 90° in the counter-clockwise direction from the orientation shown in FIG. 16A, FIG. 16B, FIG. 16C, FIG. 16D, FIG. 16E and FIG. 16F.

FIG. 24 shows the normalized intensity through the focal plane at 35 kHz for an exemplary embodiment of the lens of the present invention. The beamwidth at 0.5 of the normalized intensity was calculated to be 0.44λ, as noted in FIG. 24.

FIG. 25A and FIG. 25B shows the experimental sound pressure level gain (dB) at 33.5 kHz for an exemplary embodiment of the lens of the present invention. The gain in the focal plane is shown in FIG. 25A, and the gain through the focal point along the horizontal line from FIG. 25A is shown in FIG. 25B.

DETAILED DESCRIPTION OF EXAMPLE EMBODIMENTS

Figure 1:
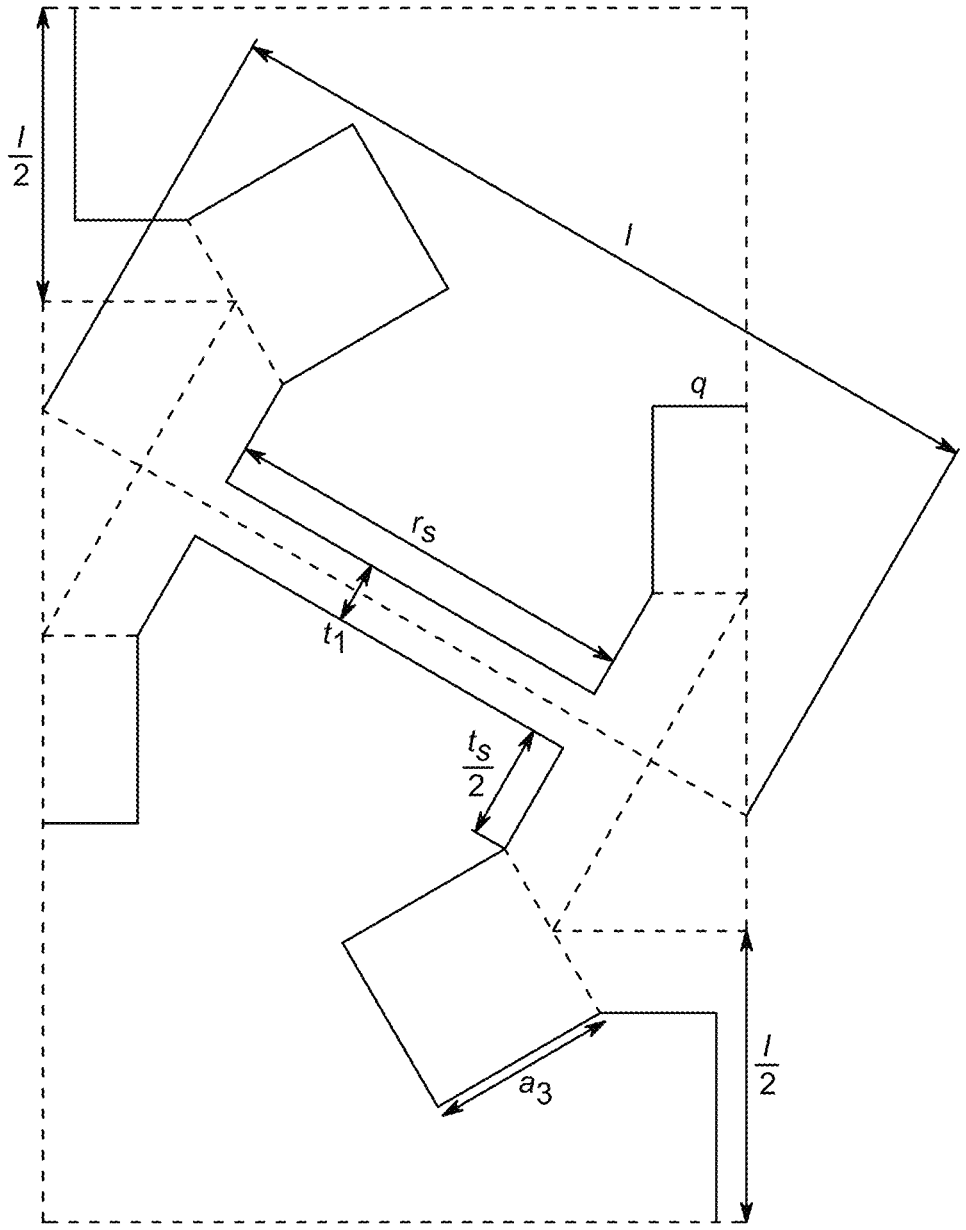
FIG. 1 provides a schematic diagram of acoustically transparent metamaterial and shows the basic element of a unit cell.

Example embodiments are described herein in the context of material structures, systems, processes, methods and computer programs for fabricating acoustically transparent materials and acoustic wave steering materials used for a metal acoustic lens and other applications. Those of ordinary skill in the art will realize that the following description is illustrative only and is not intended to be in any way limiting. Other embodiments will readily suggest themselves to those skilled in the art having the benefit of this disclosure. Reference will now be made in detail to implementations of the example embodiments of the invention as illustrated in the accompanying drawings. The same reference indicators will be used to the extent possible throughout the drawings and the following description to refer to the same or like items.

This disclosure describes an acoustically transparent material including an acoustic wave steering material, and methods for fabrication and use thereof. The materials are specially designed structures of homogenous isotropic metals; these structures are constructed to propagate waves according to Pentamode elastic theory. The metamaterial structures are two-dimensional, intended to propagate acoustic waves in the plane in a manner which closely emulates the propagation of waves in water. The acoustically transparent materials described herein can have particular utility as acoustic wave steering materials and metal acoustic lenses.

Metal Water

Metal water is metal that is structurally altered by removing material in a spatially periodic fashion. The remaining metal has the appearance of a metallic foam, but with a very well designed regular structure, so that the overall properties emulate those of water. Metal Water has the same density and longitudinal sound speed as water, and the rigidity is low but not zero. Metal water can be used as a starting material to make a new class of materials that allow acoustic energy in water to be controlled, redirected, and bent so that the sound can travel around objects under water. The idea is to mechanically alter or deform the metal water so that the new metal water has sound speed that varies in direction and in position. The metal water may be used for designing and fabricating a metal acoustic lens for underwater sound as will be described in greater detail herein.

In one example embodiment, an acoustically transparent material may be a machined or fabricated regular hexagonal network of metal, such as aluminum, or another elastic solid material, (e.g., steel or brass), that has the effective two-dimensional elastic properties (e.g., Young's modulus, Shear Modulus, mass density, etc.) of water, and is referred to as "Metal Water." Therefore this metal metamaterial is almost acoustically indistinguishable from water—when placed in water with the space between the metal sealed, this material allows acoustic waves to pass through undisturbed with minimal reflection or backscatter. The air contained in the space between the metallic foam can be occupied by other material and has effect on the passage of sound as long as the material is not in contact with the metal. This feature provides the foundation for its use as a metamaterial for acoustic cloaking devices, for example.

Figure 2:
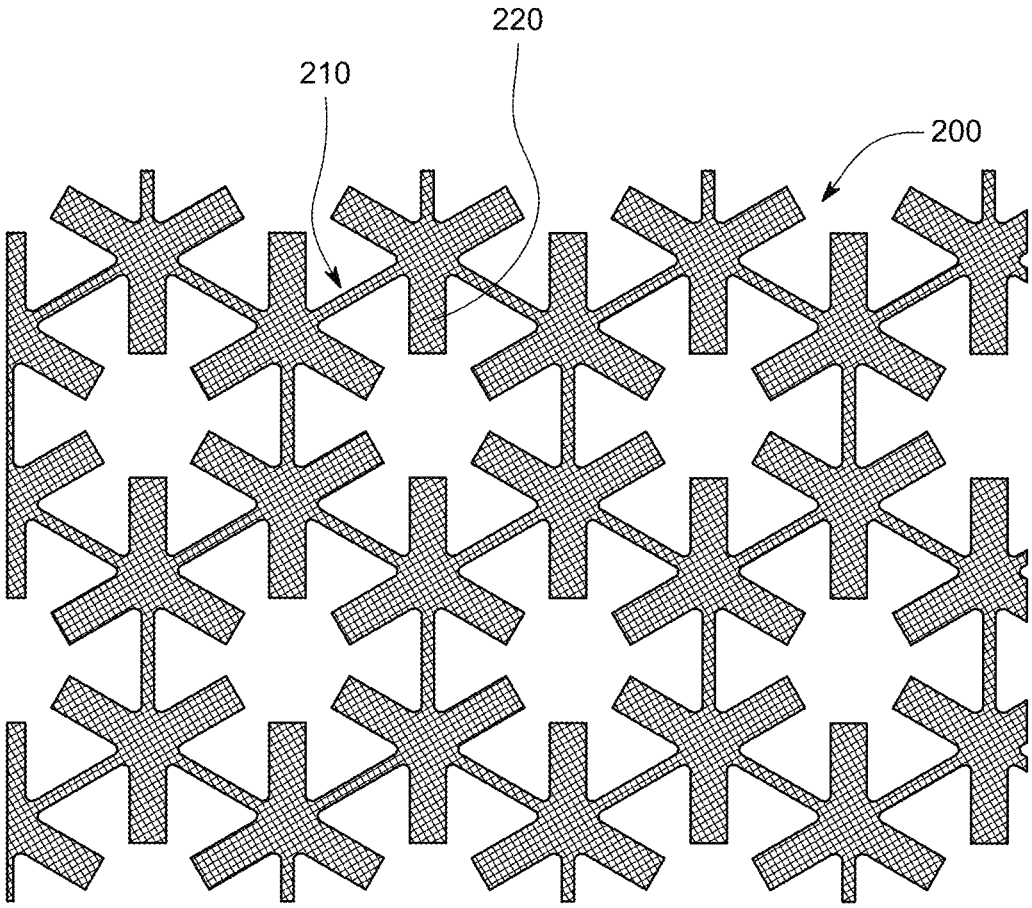
FIG. 2 illustrates a two-dimensional periodic arrangement of acoustically transparent metamaterial.

FIG. 1 shows one example design of an acoustically transparent two-dimensional material structure made out of Aluminum. The structure consists of a unit hexagonal cell formed from the element illustrated in FIG. 1 and arranged periodically. FIG. 2 shows a two-dimensional periodic arrangement 200 of hexagonal cells 210, in which each hexagonal cell 210 includes a plurality of lobes 220 extending inwardly from the vertices of the hexagonal cell. The design for pentamode materials shall consist of similar periodic arrangements of irregular hexagons (as opposed to regular hexagons). The design in FIG. 3 has effective elastic properties (in GPa) shown below:

$$C = \begin{bmatrix} 2.21 & 2.11 & 0 \\ 2.21 & 2.11 & 0 \\ 0 & 0 & 0.052 \end{bmatrix}.$$

wherein C is the matrix of elastic stiffnesses [1, 2]

$$C = \begin{pmatrix} C11 & C12 & C16 \\ C12 & C22 & C26 \\ C16 & C26 & C66 \end{pmatrix}$$

These properties are remarkably close to the target properties of water (in two dimensions) in (GPa):

$$C = \begin{bmatrix} 2.25 & 2.25 & 0 \\ 2.25 & 2.25 & 0 \\ 0 & 0 & 0.0 \end{bmatrix}.$$

Figure 3:
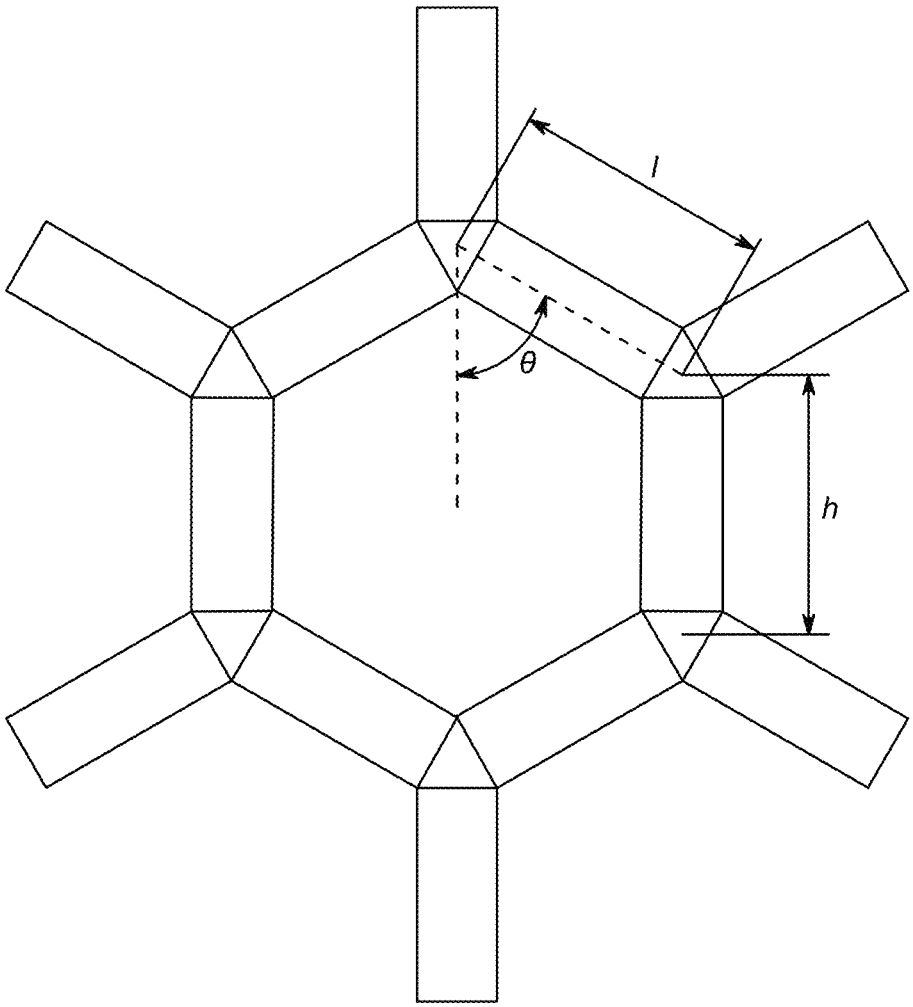
FIG. 3 illustrates schematically a unit cell for a wave steering material.

FIG. 3 shows the schematic for a unit cell of wave steering material. The structure consists of a six-sided unit cell with adjustable lengths l and h, and interior angle θ. The elastic stiffness has pentamode form represented by the following equation:

$$C = C_O \begin{pmatrix} \alpha & 1 & 0 \\ 1 & 1/\alpha & 0 \\ 0 & 0 & 0 \end{pmatrix}.$$

$$C_O = (\sin\theta \quad \cos\theta)/(2h(M_i + 2M_h\sin^2\theta))$$

$$\alpha = \frac{l\cos\theta\cos\theta}{(h + l\sin\theta)\sin\theta}$$

The parameter α, which determines the degree of pentamode properties, may be modified by choice of the design parameters l, h and θ.

Fabrication of metal water into a desired structure may first involve preparing a computer aided drawing (CAD) of the part or structure. This is achieved by selecting microstructure of the unit cell, as exemplified in FIG. 1, which finally results in the CAD drawing shown in FIG. 2. The formulas above provide an initial estimate for the design, from FIG. 3. The intermediate steps employ use of computer software, such as the Finite Element Method (FEM), to ensure that the piece depicted by the CAD drawing has the desired properties of the density of water, and the elastic stiffness of water. The example described above for the matrix of elastic stiffness was arrived at using different FEM software packages (e.g., COMSOL, ANSYS, Abaqus) as a check on each other. In the example described herein, the lengths l and h are equal to one another and the angle θ is 60 degrees (e.g., FIG. 3). These parameters can be altered to achieve other realizations of the metamaterial suitable for a metal acoustic lens. Other design considerations include selecting the two lengths l and h to make the unit cell as small as possible. This depends on the metal to be used. For aluminum, for example, a cell size of less than 1 inch square is feasible using the water jet process machinery available at the time of filing. Smaller cell sizes may be possible, for example, using other materials (e.g., steel, tin, lead, or brass, etc.) or other manufacturing methods (e.g., powder sintering, conventional milling, laser cutting, extrusion, etc.).

Actual fabrication of the material may be performed, for example, by numerically controlled cutting machines using a CAD drawing to operate the machine. The fabrication can use stock plates of metal, available in a variety of sizes. As an example, a 1 inch by 1 inch by 12 inch block of aluminum is machined using water jet cutting. A water jet cutter, also known as a waterjet, is a tool capable of slicing into metal or other materials using a jet of water at high velocity and pressure. Computer control is essential to achieve the tolerances for the CAD design, which is ported to the machinist electronically. Machining tolerance of less than 0.1 mm is desirable, but larger values are acceptable. Current cutting machines, including waterjets, are capable of using CAD designs from many different software packages, such as SolidWorks. Alternative cutting machines can also be used, such as numerically controlled wire-cut electrical discharge machining (EDM).

In summary, fabrication first employs an accurate CAD design suitable to control a computer assisted cutting machine. The initial steps in the development of the CAD drawing start with the equations above to estimate the parameters l and h, which define the size of the unit cell in the regular array. Simultaneous design of the overall density and the elastic stiffness is verified by FEM to ensure accuracy in mimicking the density and elastic stiffness of water. Fabrication is by computer assisted cutting machinery controlled by the CAD design code. The desired tolerances can be achieved by many types of machinery, including, for example, water cutting machines or by wire-cut electrical discharge machinery. It should be also noted that use of metal is merely exemplary and other materials having similar properties may be used to fabricate acoustically transparent metamaterial using principles and method disclosed herein in alternative embodiments. For example, those skilled in the art will realize that fabrication of acoustic transparent materials using silicon or PZT (lead zirconate titanate) may have applications in sensing and design of impedance matched transducers, respectively.

Metal Acoustic Lens

According to one example embodiment, the above-described metal water may be employed to fabricate a metal acoustic lens. An accurate and useful acoustic lens should focus sound waves in a precise manner, which requires a lens with smoothly varying acoustic properties, specifically acoustic sound speed and density. In accordance with the lens described herein, both of these acoustic properties may be varied smoothly and simultaneously.

Figure 4:
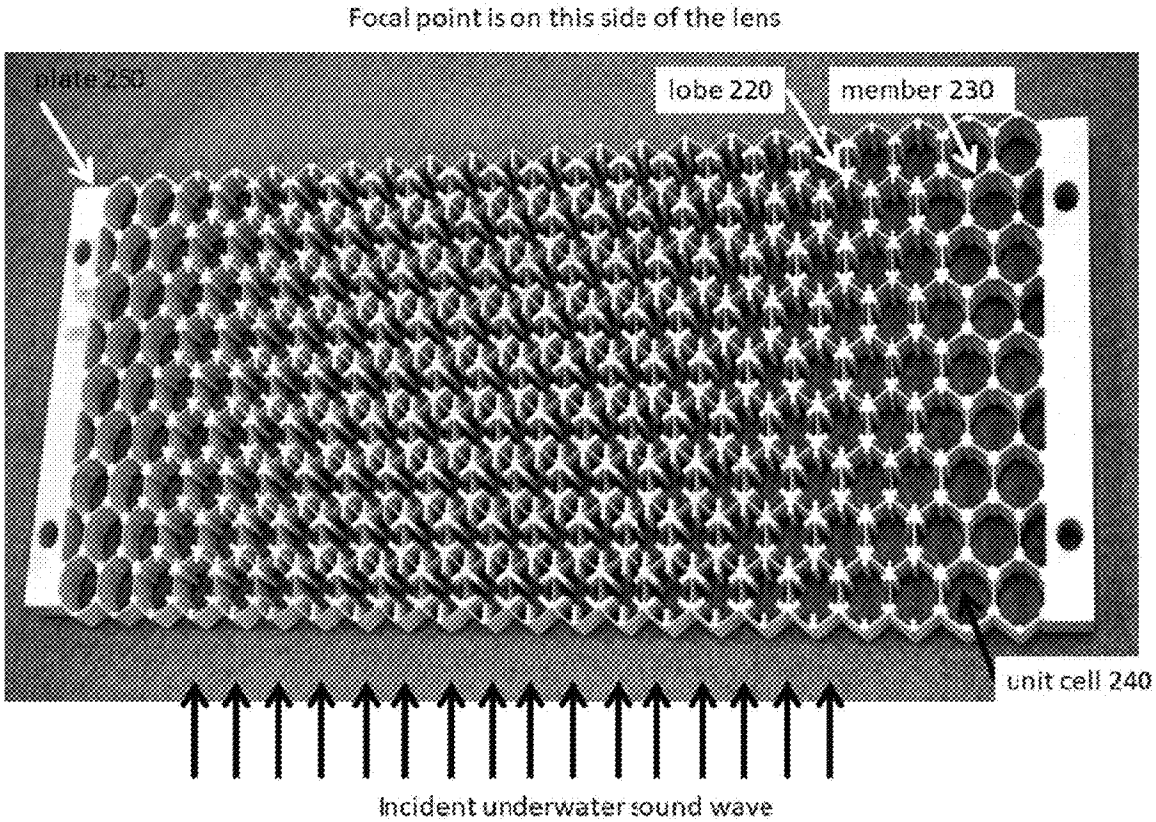
FIG. 4 shows a section of an embodiment of a metal acoustic lens (a plate, or piece, of the lens).
Figure 5:
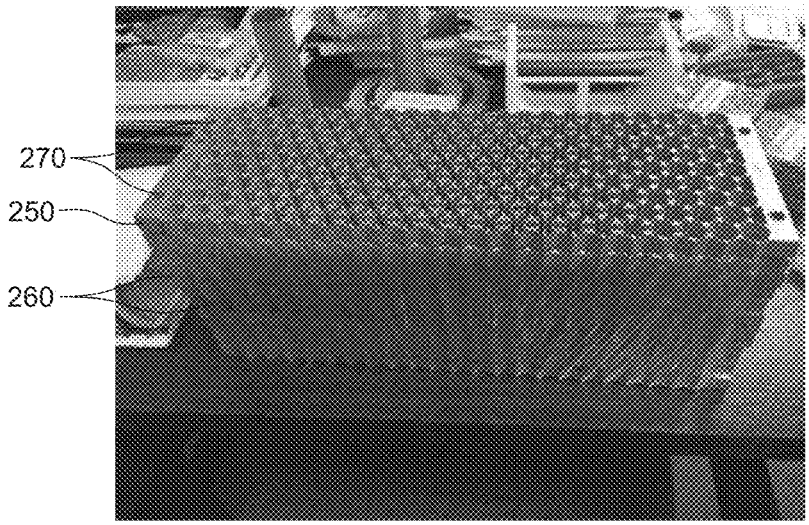
FIG. 5 shows an embodiment of a metal acoustic lens assembled from a stack of metal plates.
Figure 6:
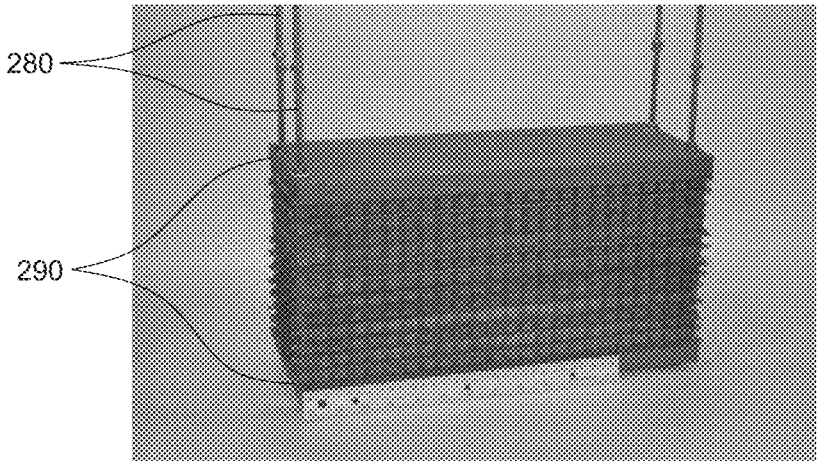
FIG. 6 shows an embodiment of a metal acoustic lens which is sealed on the top and bottom by cover plates to seal the interior of the lens from the outside water. Each of the two aluminum cover plates (or end caps) are 2 cm thick, with four steel rods compressing the twelve lens places (or pieces) and alternating with 1-mm thick neoprene gaskets. A 12 inch ruler is included for scale.

An exemplary embodiment of the metal acoustic lens is shown in FIGS. 4-6. FIG. 4 shows a section of the lens (a plate (or piece) 250 of the lens), wherein the size of the hexagonal lobes 220 are varied along the plate 250 in the longitudinal direction to vary the speed of and thereby focus the sound waves. The size of the plate 250 shown in FIG. 4 is, for example, 40 cm long and 13.7 cm wide. FIG. 5 shows the lens assembled from a stack of identical metal plates 250. In FIG. 5, the plates 250 are separated from each other by a thin rubber gasket 260 between a pair of plates 250 (such that the sequence of the stack is plate 250, gasket 260, plate 250, gasket 260, plate 250, etc.) to seal the interior from the exterior water when the lens is placed under water. Although in FIG. 5 rubber is the gasket material, the gasket can be made from other types of resilient materials, such as silicone, other polymers, or any other soft, rubber-like material. In addition, although the exemplary embodiment of the lens shown in FIGS. 5-6 contains twelve stacked plates 250, a plurality of stacked plates 250 is sufficient to construct the lens. For example, the lens may contain a stack of 2, 3, 4, 5, 6, 7, 8, 9, 10, 11, 12, 13, 14, 15, 16, 17, 18, 19, 20 or more than twenty plates 250.

Also shown in FIG. 5 are the pre-drilled holes 270 in the metal plates 250 through which metal rods 280 will be placed to align the metal acoustic lens in its final form. FIG. 6 shows the metal acoustic lens which is sealed on the top and bottom by cover plates 290 to seal the interior of the lens from the outside water. Thus, the interior of the lens is filled with air, and only the exterior faces are connected to water. During typical operation, the lens is in water with sound incident from one side (see FIG. 6) being focused on the other side of the lens. As such, incoming sound waves can be focused under water. The metal acoustic lens is able to provide a sharp focus by virtue of the gradient index properties of the metal plates 250 and the constant acoustic impedance. Preferably, the lens operates at frequencies from 20 to 40 kHz, more preferably from 25 to 40 kHz, and even more preferably from 30 to 40 kHz. It should again be noted that use of metal is merely exemplary and other materials, and other metals besides aluminum, having similar properties may be used to fabricate acoustically transparent metamaterial using principles and methods disclosed herein in alternative embodiments. In addition, although the lens shown in FIGS. 4-6 preferably operates at frequencies from 20 to 40 kHz, more preferably from 25 to 40 kHz, and even more preferably from 30 to 40 kHz, it should be understood that the preferred frequency range of operation will vary for other embodiments of the lens that have unit cells with different sizes and different shapes.

In reference to the plate shown in FIG. 4, there are three aspects to the particular design of the plate 250. First, the thickness of the thin members 230 between the star-shaped vertices. The members 230 make up the six sides of the hexagonal unit cells 240 shown in FIG. 4. Second, the size of the star or the lobes 220 at the vertices. Third, the hexagonal arrangement of the unit cells 240. The first two features (the thickness and length of the members 230 and the size of the star or the lobes 220) vary across the plate in the longitudinal direction and allow the sound speed and density to be smoothly varied in such a manner that the device acts as a lens. The smooth variation of these structural parameters ensures that the acoustic properties, speed and density, vary in the required manner to provide the focusing. This is achieved by varying the sound speed, also known as index, in such a way that the sound is focused. At the same time, the acoustic impedance, which is the product of density and sound speed, is kept constant at the value for water. Thus, the unit cells 240 have an acoustic impedance that is the same as the acoustic impedance for water, i.e., they are impedance matched to water. This is important in obtaining optimal focusing effect, as it minimizes the reflection of the incident sound and maximizes the focusing effect of the lens. The hexagonal shapes of the unit cells 240 ensure that the material is locally isotropic. Preferably, the unit cells 240 are transversely isotropic. The metal acoustic lens may include arrangements of regular hexagonal unit cells (i.e., with equilateral sides) or irregular cells (i.e., with sides of different lengths or unequal angles). It should also be noted that use of hexagonally shaped unit cells is merely exemplary and other polygonal shapes and configurations, both regular and irregular, may be used to fabricate acoustically transparent metamaterial using principles and methods disclosed herein in alternative embodiments.

Figures 12A, 12B:
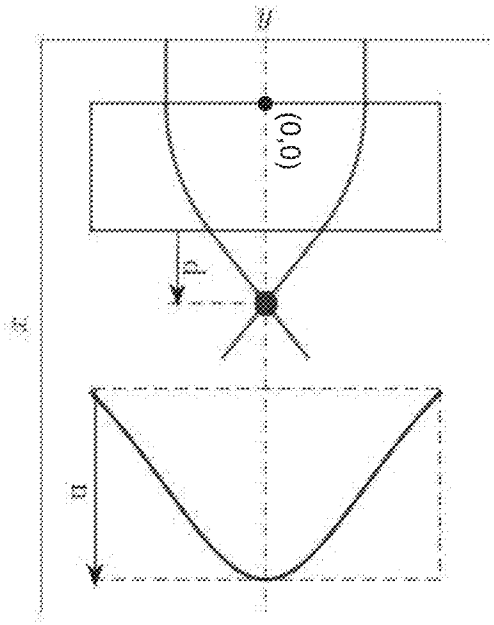
FIG. 12A shows a schematic view of an example of a lens, along with two ray paths which focus a distance d from the lens surface. And the corresponding index of refraction profile within the lens is shown in FIG. 12B.

The dimensions of the plate parameters are arrived at by first using a model for lens design from optics which dictates the index of sound (inverse of speed) as a function in the direction orthogonal to the plane wave incidence. This optics-based model has significant aberration degrading the focusing effect. In addition, the following new model has been developed by the inventors that removes the aberration by using a coordinate stretch in the same direction. The rectangular outline of the two-dimensional lens is designed as depicted in FIG. 12A and FIG. 12B with index profile symmetric with respect to the x-axis (y=0). Assuming that the refractive index n is a function only of y, the trajectories of a normally incident wave can be derived by solving a ray equation for y=y(x) based on the fact that the component of slowness along the interface between each layer is constant:

$$\frac{n(y(x))}{\sqrt{1+y'^2(x)}} = n(y_0) \tag{1}$$

where $y_0$=y (0) is the incident position on the y-axis at the left side of the lens, x=0. The focal distance from the right-hand boundary of the GRIN lens at x=t is $$d = y_t\sqrt{\frac{1}{n^2(y_t)-n^2(y_0)}-1}\,. \tag{2}$$

The new model next considers a hyperbolic secant index profile n(y):

$$n(y)=n_0 sech(\alpha y), \tag{3}$$

where $n_0$ and $\alpha$ are constants. This profile, also known as a Mikaelian lens (A. L. Mikaelian et al., Self-focusing media with variable index of refraction, Progress in Optics, pages 279-345, 1980), was originally proposed by Mikaelian for both rectangular and cylindrical coordinates, and is often used to design for low aberration. The ray trajectory is $$y(x) = \frac{1}{\alpha}\sinh^{-1}[\sinh(\alpha y_0)\cos(\alpha x)]. \tag{4}$$

Alternatively, consider the quadratic index profile $$n(y)=n_0\sqrt{1-(\alpha y)^2}, \tag{5}$$

for which the rays are:

$$y(x) = y_0\sqrt{2}\sin\left(\frac{\pi}{4}-\frac{n_0\alpha x}{n(y_0)}\right). \tag{6}$$

Martin et al. (T. P. Martin et al., Transparent gradient index lens for underwater sound based on phase advance, Phys. Rev. Appl., 4(3), 2015) noted that the above two profiles have opposite aberration tendencies, and proposed a mixed combination which shows reduced aberration. However, in the lens of the current invention, a wider range in index is desired, from unity (1) to about 0.5 (unlike Martin et al. above, for which the minimum is 1/1.3=0.77). This requires $\alpha y_0$ to exceed unity, which rules out the use of the quadratic profile. Notably, the purpose of using a wider range of index is to fully exploit the bulk space of the lens to achieve near field focusing capability.

For a reduced aberration profile, the new model uses a modified hyperbolic secant profile by stretching the y-coordinate, as follows:

$$n(y)=n_0 sech(g)(\alpha y)) \text{ where}$$

$$g(z)=z/(1+\beta_1 z^2+\beta_2 z^4). \tag{7}$$

The objective is to make d of Equation (2) independent of $y_0$ as far as possible. For small $\alpha y_0$ we have from both Equations (4) and (6) that $y(x)\approx y_0 \cos \alpha x$, and hence for all three profiles $$d \to d_0 \equiv \frac{1}{n_0\alpha}\cot\alpha t \text{ as } \alpha y_0 \to 0. \tag{8}$$

Figure 13A:
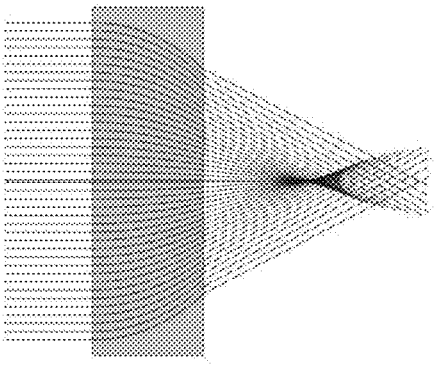
FIG. 13A and FIG. 13B shows a ray tracing comparison between FIG. 13A the hyperbolic secant profile and FIG. 13B the reduced aberration profile.
Figure 13B:
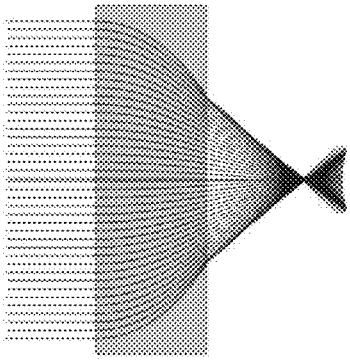

Note that do is independent of $y_0$, as expected. This is the value of the focal distance that the modified profile (Equation 7) attempts to achieve for all values of $y_0$ in the device by selecting suitable values of the non-dimensional parameters $\beta_1$ and $\beta_2$. For example, numerical experimentation led to the choice of $\beta_1$=−0.0679 and $\beta_2$=−0.002. As a demonstration of aberration reduction, a plot of the ray trajectories with (b) and without (a) the stretch in the y-direction are shown in FIG. 13A and FIG. 13B for comparison. It is clear from FIG. 13A and FIG. 13B that the modified secant profile is capable of focusing a normally incident plane wave with minimal aberration.

The model for the index profile was then converted to the pentamode structure by assuming the lens has six different types of unit cells, which are chosen to approximate the required index variation. The six types of cells are then joined so as to form the structure shown in FIG. 4. Iteration by computer simulation lead to the design shown, which is made to operate in a bandwidth around 30 kHz. The frequency of operation determines the unit cell sizes, and the pentamode model gives the lobe and member lengths and thicknesses for the metal used, which was aluminum in the example shown in FIG. 4. This design uses identical plates, which generates a two-dimensional or cylindrical focus. A plurality of the identical plates having the same design and index gradient, for example, as shown in FIG. 4, are then stacked to form the lens.

Fabrication of a metal acoustic lens follows all of the steps outlined above with respect to metal water, but in addition, includes consideration of the inhomogeneous nature of the structure. Instead of a regular periodic array as shown in FIG. 2 for the metal water, the metal acoustic lens requires varying the size of the lobes 220 along a gradient to vary the speed and thereby focus the sound waves, as depicted in FIG. 4. Such a design is fabricated by a process similar to above but with different design variables, such as l, h and θ (FIG. 3). Once the variation of the lobes 220 has been defined, the fabrication process proceeds as before, in a series of FEM calculations to verify the CAD design has the correct and appropriate properties. Actual fabrication may use the same numerically controlled machine cutting tools.

According to another example embodiment of the metal acoustic lens, the above-described metal water may be employed to fabricate a metal acoustic lens that focuses the sound inside of the metal structure. This embodiment uses a more precise basis for design, called transformation acoustics, which provides accurate focusing over a broad range of frequencies. Transformation acoustics uses an exact mapping of the acoustic wave equation which is not restricted by ray optics, but is exact at all wavelengths. The only approximations made are in the fabrication of the pentamode structure which places a limitation on the wavelengths by virtue of the unit cell size. A smaller unit cell size is preferred, but there is a limit on the machining capability for the metal used.

Figure 7:
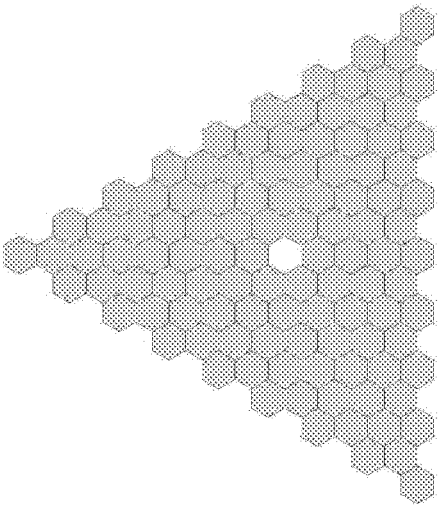
FIG. 7 shows a drawing of an embodiment of a metal acoustic lens that has a cavity in the middle of the lens to receive a sound transmitter.
Figure 9:
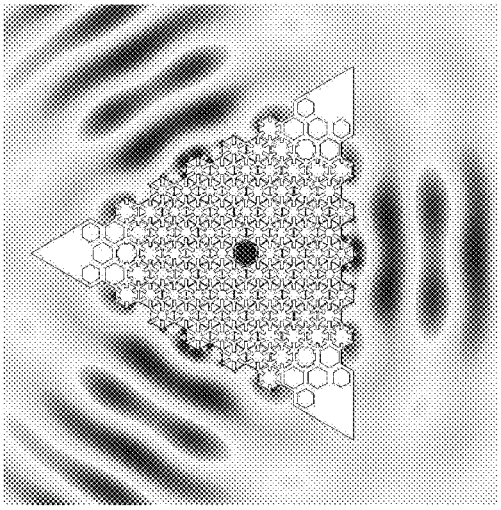
FIG. 9 shows an example of the sound waves from a metal acoustic lens depicted in FIG. 7 at 20.5 kHz.
Figure 10:
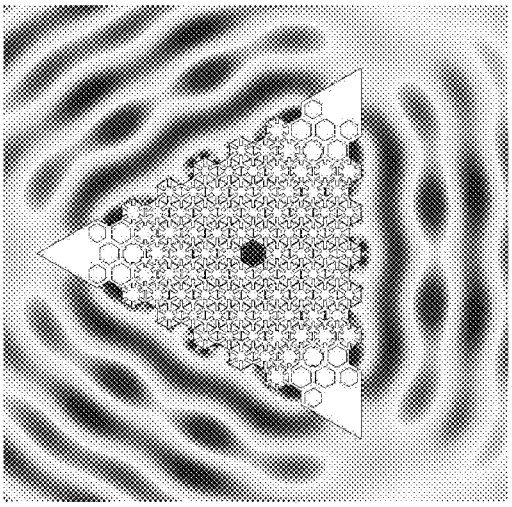
FIG. 10 shows an example of the sound waves from a metal acoustic lens depicted in FIG. 7 at 21.4 kHz.

According to another example embodiment of the metal acoustic lens, the above-described metal water may be employed to fabricate a metal acoustic lens that has a cavity in the middle of the lens to receive a sound transmitter wherein the lens functions to amplify a sound wave when it is transmitted from the transmitter. In this embodiment, the plates may be triangular shaped. FIG. 7 shows a drawing of such a plate of the lens (shown without the lobes 220), wherein each side of the plate has a length of, for example, 32.5 cm. FIGS. 9 and 10 show the sound waves from such a lens at 20.5 kHz (FIG. 9) and 21.4 kHz (FIG. 10). The design of this lens is also based on transformation acoustics, a more precise lens technique that has not been previously applied in this context.

Figure 8:
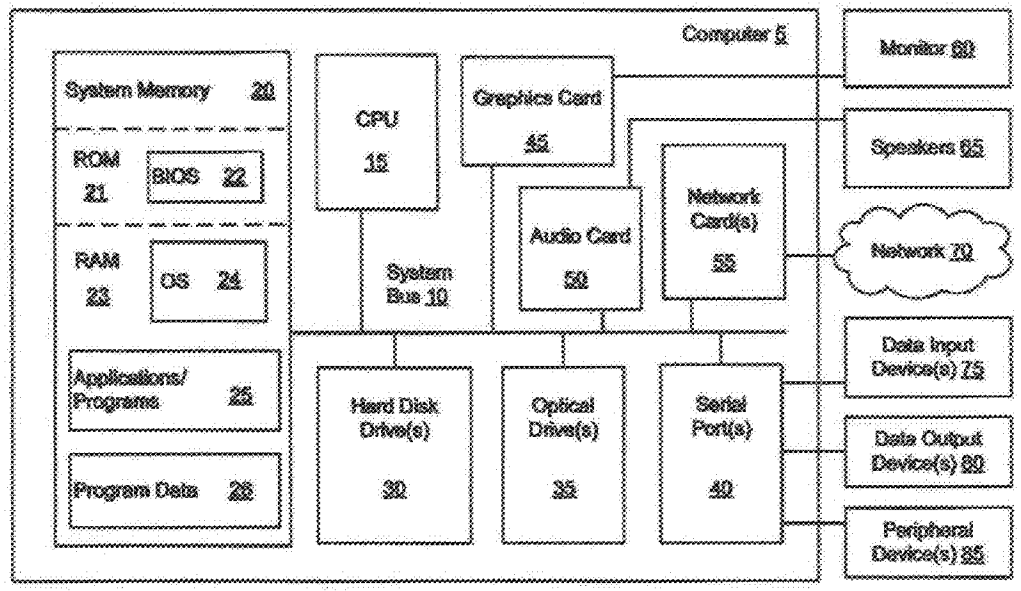
FIG. 8 illustrates a schematic diagram of a computer system for implementing methods for designing metal acoustic lenses as disclosed herein.
Figure 11:
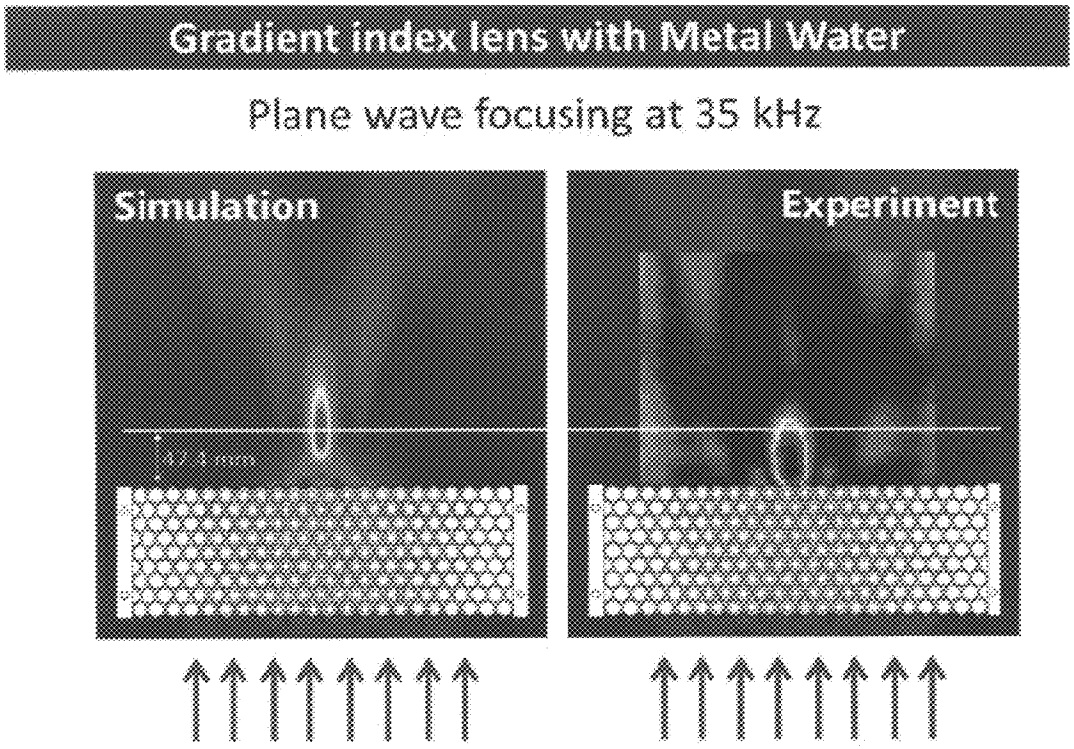
FIG. 11 shows results of plane wave focusing at 35 kHz for a simulation and an experiment using a metal acoustic lens. The simulation is for a two-dimensional model of the designed structure. The experiment was for the full metal acoustic lens made from the stack of plates as shown in FIG. 6.

The design and optimization processes described above may be actualized using software written for general-purpose computers. The software incorporates one or more of the algorithms described above and may be written in any source language (e.g., C++, FORTRAN, etc.) and compiled for a general purpose computer. FIG. 8 illustrates one example embodiment of a computer system 5, such as a personal computer (PC) or a server, suitable for implementing the above-described process design methodology of a metal acoustic lens. As shown, computer system 5 may include one or more processors 15, memory 20, one or more hard disk drive(s) 30, optical drive(s) 35, serial port(s) 40, graphics card 45, audio card 50 and network card(s) 55 connected by system bus 10. System bus 10 may be any of several types of bus structures including a memory bus or memory controller, a peripheral bus and a local bus using any of a variety of known bus architectures. Processor 15 may include one or more Intel® Core 2 Quad 2.33 GHz processors or other type of general purpose microprocessor.

System memory 20 may include a read-only memory (ROM) 21 and random access memory (RAM) 23. Memory 20 may be implemented as in DRAM (dynamic RAM), EPROM, EEPROM, Flash or other type of memory architecture. ROM 21 stores a basic input/output system 22 (BIOS), containing the basic routines that help to transfer information between the components of computer 5, such as during start-up. RAM 23 stores operating system 24 (OS), such as Windows® XP Professional or other type of operating system, that is responsible for management and coordination of processes and allocation and sharing of hardware resources in computer system 5. System memory 20 also stores applications and programs 25, such as MathCAD. System memory 20 also stores various runtime data 26 used by programs 25 as well as various databases of information about CAD designs.

Computer system 5 may further include hard disk drive(s) 30, such as SATA magnetic hard disk drive (HDD), and optical disk drive(s) 35 for reading from or writing to a removable optical disk, such as a CD-ROM, DVD-ROM or other optical media. Drives 30 and 35 and their associated computer-readable media provide non-volatile storage of computer readable instructions, data structures, databases, applications and program modules/subroutines that implement algorithms and methods disclosed herein. Although the exemplary computer system 5 employs magnetic and optical disks, it should be appreciated by those skilled in the art that other types of computer readable media that can store data accessible by a computer system 5, such as magnetic cassettes, flash memory cards, digital video disks, RAMs, ROMs, EPROMs and other types of memory may also be used in alternative embodiments of the computer system.

Computer system 5 further includes a plurality of serial ports 40, such as Universal Serial Bus (USB), for connecting data input device(s) 75, such as keyboard, mouse, touch pad and other. Serial ports 40 may be also be used to connect data output device(s) 80, such as printer, scanner and other, as well as other peripheral device(s) 85, such as external data storage devices and the like. System 5 may also include graphics card 45, such as nVidia® GeForce® GT 240M or other video card, for interfacing with a monitor 60 or other video reproduction device. System 5 may also include an audio card 50 for reproducing sound via internal or external speakers 65. In addition, system 5 may include network card(s) 55, such as Ethernet, WiFi, GSM, Bluetooth or other wired, wireless, or cellular network interface for connecting computer system 5 to network 70, such as the Internet.

In various embodiments, the algorithms and methods described herein may be implemented in hardware, software, firmware, or any combination thereof. If implemented in software, the functions may be stored as one or more instructions or code on a non-transitory computer-readable medium. Computer-readable medium includes both computer storage and communication medium that facilitates transfer of a computer program from one place to another. A storage medium may be any available media that can be accessed by a computer. By way of example, and not limitation, such computer-readable medium can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection may be termed a computer-readable medium. For example, if software is transmitted from a website, server, or other remote source using a coaxial cable, fiber optic cable, twisted pair, digital subscriber line (DSL), or wireless technologies such as infrared, radio, and microwave are included in the definition of medium.

Example

Figure 14:
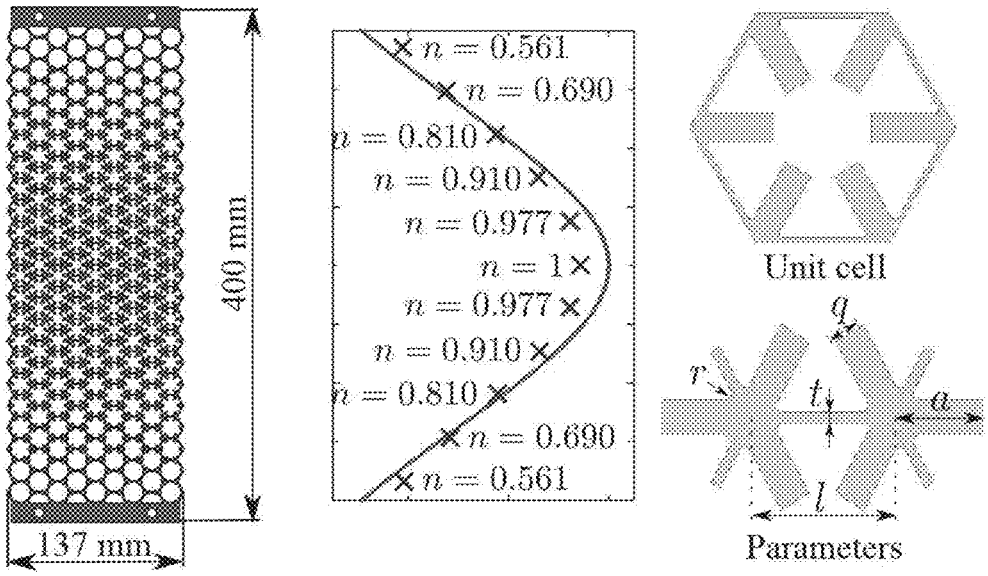
FIG. 14 shows the design of an exemplary embodiment of the lens of the present invention, with the picture on the left side showing the top view of the lens, the plot in the middle showing the discretized index distribution within the lens, and the right side showing the unit cell structure and parameters.

An exemplary embodiment of the lens of the present invention is designed using six types of unit cells corresponding to the discrete values selected from the modified hyperbolic index profile. FIG. 14 shows the spatial distribution of refractive indices of the exemplary embodiment of the lens. The unit cell structure is the regular hexagonal lattice which has in-plane isotropy at the quasi-static regime (see A. N. Norris, Mechanics of elastic networks, Proc. R. Soc. A, 470(2172):20140522, 2014). Using Voigt notation, the two-dimensional pentamode elasticity requires $C_{11}C_{22}\approx C^2_{12}$ and $C_{66}\approx 0$ to minimize the shear modulus. With these requirements satisfied, the main goal is to tune the effective $C_{11}$ and mass density at the homogenization limit to achieve the required refractive index and match the impedance to water simultaneously. The material properties of water are taken as bulk modulus $\kappa_0$=2.25 GPa and density $\rho_0$=1000 kg/m$^3$. The material of the lens slab is aluminum with Young's modulus E=70 GPa, density $\rho$=2700 kg/m$^3$ and Poisson's ratio $\nu$=0.33. The geometric parameters of each unit cell, as shown in FIG. 14, are predicted using foam mechanics (see H. S. Kim et al., A morphological elastic model of general hexagonal columnar structures, Int. J. Mech. Sc., 43(4):1027-1060, 2001) and iterated using a homogenization technique based on FEM (see B. Hassani et al., A review of homogenization and topology optimization I-homogenization theory for media with periodic structure, Comp. Struct., 69(6):707-717, 1998). The geometric parameters of the six types of unit cells for the exemplary embodiment of the lens are listed below in Table I. Note that a larger value of the radius r at the joints increases the effective shear modulus, but r=0.420 mm was the limit of the machining method utilized in this exemplary embodiment.

TABLE I

Parameters of the unit cells corresponding to different values of refractive index as shown in FIG. 14.

| $n_{eff}$ | l (mm) | t (mm) | a (mm) | q (mm) | r (mm) |
|---|---|---|---|---|---|
| 1.000 | 9.708 | 0.693 | 6.025 | 2.184 | 0.420 |
| 0.977 | 9.708 | 0.708 | 5.844 | 2.184 | 0.420 |
| 0.910 | 9.708 | 0.761 | 5.295 | 2.184 | 0.420 |
| 0.810 | 9.708 | 0.851 | 4.451 | 2.184 | 0.420 |
| 0.690 | 9.708 | 0.994 | 3.397 | 2.184 | 0.420 |
| 0.561 | 9.708 | 1.213 | 2.177 | 2.184 | 0.420 |

Figure 15A:
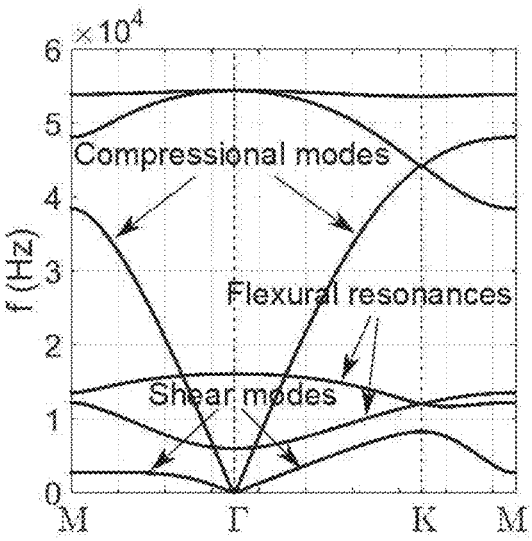
FIG. 15A, FIG. 15B and FIG. 15C shows a band diagram (FIG. 15A) of the unit cell (FIG. 15B) at the center ($n_{eff}$=1) along the Γ-M-K of the first Brillouin zone (FIG. 15C).

The lens is comprised of the six types of unit cells described above, the minimum cutoff frequency is limited by the unit cell with thinnest plates, i.e. $n_{eff}$=1, thus it is important to examine its band structure. The band diagram as shown in FIG. 15A is calculated using Bloch-Floquet analysis in COMSOL. The directional band gap along the incident direction occurs near 40 kHz, which sets the upper limit of the lens. The lens is designed following an index gradient, therefore the low frequency focusing capability is limited due to the high frequency approximation nature of the ray theory. Although bending modes exist at low frequency range, they do not cause much scattering due to sufficient shear modulus which prevents the structure from flexure (see X. Cai et al., The mechanical and acoustic properties of two-dimensional pentamode metamaterials with different structural parameters, Appl. Phys. Lett., 109 (13):131904, 2016). The lens should be capable of focusing underwater sound over a broadband from 10 kHz to 40 kHz.

Figure 15B:
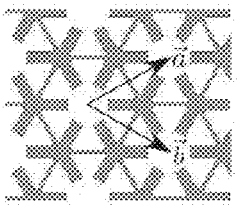
Figure 15C:
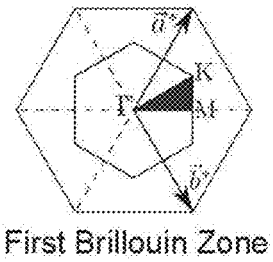

The lens is formed by combining all the designed unit cells together following the reduced aberration profile. In this example, the length of the lens was 40 cm, and the width was 13.7 cm. The material of the lens was aluminum, and the gradient index is permeated with air and immersed in water so that only a structural wave is allowed in the lens. Full wave simulations were done to demonstrate the broadband focusing effect using COM-SOL Multiphysics. FIGS. 16A-16F shows the intensity magnitude normalized to the maximum value at the focal point from 15 to 40 kHz. A Gaussian beam is normally incident from the left side, and the focal point lies on the right side of the lens. In view of these results, it is clear that the lens works over a broad range of frequency. In the focal plane, the high intensity focusing region moves towards the lens as the frequency increases. The low frequency focusing capability is limited due to the high frequency approximation nature of the index gradient, while the high frequency is limited because the longitudinal mode becomes dispersive as shown in FIGS. 15A-15C, i.e., the effective speed is reduced. Per FIGS. 16A-16F, the preferred operation frequency of the lens is found to be about 20 kHz where the longitudinal mode is non-dispersive, and the cutoff frequency is about 40 kHz, as predicted in the band diagram of FIGS. 15A-15C.

The exemplary embodiment of the lens in this example has minimized side lobes as compared to conventional diffractive lens. Diffractive acoustic lenses are usually designed by tuning the impedance of each channel to achieve certain phase delay. However, the transmitted amplitudes are different so that it is hard to cancel out the side lobes caused by aperture diffraction. A main advantage of the exemplary embodiment of the lens in this example is that it redirects the ray paths inside the lens, and reduces the diffraction aperture to a minimal size at the exiting face of the lens. FIG. 17 shows the normalized intensity magnitude across the focal point along the lens face. The width of the intensity profile at half of its maximum is only 0.47$\lambda$ at 35 kHz. The focal distance at this frequency is about 5 cm. It is also shown that the intensity magnitudes of the side lobes are all below 1/10 of the maximum value such that the exemplary embodiment of the lens in this example is nearly side lobe free.

As previously discussed, the exemplary embodiment of the lens in this example is impedance matched to water so that it is acoustically transparent (back-scattering free) to a normally incident plane wave. This feature should result in a very high gain at the focal plane. FIG. 18A and FIG. 18B shows the simulated sound pressure level (SPL) gain at 33.5 kHz over the focal plane. This plot is generated by subtracting the simulated SPL without the lens from the SPL with the lens for normally incident plane wave beams. It is worth noting that the maximum gain at 33.5 kHz is as high as 11.06 dB, which is difficult to achieve for a diffractive lens, especially for a two-dimensional device. The advantage of the exemplary embodiment of the lens in this example is that it can achieve high gain and minimal side lobes at the same time, however, minimizing the side lobes for a diffractive lens is usually at the cost of introducing high impedance mismatch.

Unlike the diffractive metasurfaces, which only work at the steady state, the exemplary embodiment of the lens in this example is also capable of focusing a plane wave pulse. FIGS. 19A-19F shows the simulated pressure variations at each time frame. The acoustic pressure in all of the six plots FIG. 19A through FIG. 19F are normalized to the maximum at t=0.36 ms. Two cycles of a plane wave pulse are incident from the left side at the central frequency of 30 kHz. The wave moves towards the lens and then transmits through the lens as shown at each time frame FIG. 19A through FIG. 19F. The wave focuses on the right side of the lens and starts to spread out at about t=0.36 ms. It can also be seen from FIG. 19C, i.e., t=0.24 ms, that the reflection from the water-lens interface is almost negligible.

The exemplary embodiment of the lens in this example is pictured in FIG. 6, and was fabricated using an abrasive water jet cutting twelve pieces of 1.5 cm-thick aluminum plates. The dimensions of the plates were measured and compared to the specified dimensions in Table I above. The maximum discrepancy was 0.5 mm from the desired dimension with an average difference of 0.2 mm. These deviations were noted as a source of possible error in the experimental data. The exemplary embodiment of the lens in this example was constructed by assembling twelve fabricated plates so that the inside could be air-tight. Rubber gaskets were cut out of neoprene sheets to provide a 1 cm rubber border around the perimeter of each lens piece and the outer edge of the top and bottom of each piece was lined with a layer of electrical tape and double sided tape to hold the gaskets in place. The layers were then placed on top of one another alternating with rubber gaskets. Two cover plates of aluminum measuring 40.0 cm by 15.25 cm, and 2 cm thick were placed on the top and bottom of the stacked pieces and were compressed together using nuts and washers with four steel rods. The compression of the gaskets provided a means of overcoming possible surface irregularities on the perimeters of each piece to prevent leakage.

All the experimental measurements were done in a rectangular indoor tank approximately 4.5 m in depth with a capacity of 459 $m^3$ surrounded by cement walls with a sand covered floor. The tank was filled with fresh water and the temperature is assumed to be of negligible variance between tests. An aluminum and steel structure was constructed to secure the lens and the source separated by 1 cm at a centerline depth of 68.5 cm. The structure was attached to a hydraulically actuated cylinder that held the components at a consistent desired depth for the duration of testing. An exponential chirp at 1 ms in duration with a frequency range of 10 kHz to 70 kHz was used as the excitation signal and the signal was repeated every 100 ms.

Figure 20:
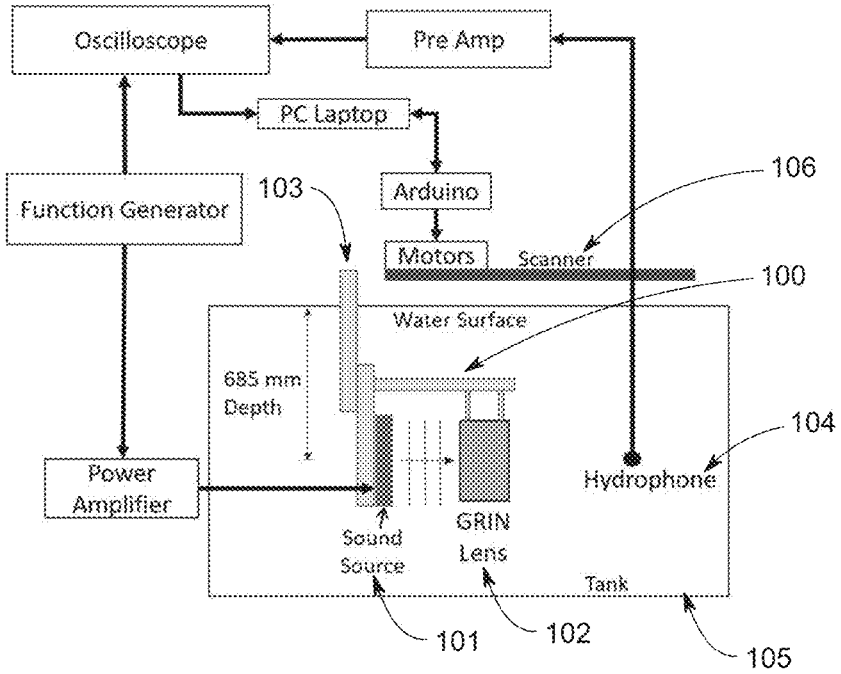
FIG. 20 shows a schematic diagram of the experimental test apparatus used to acquire hydrophone amplitude measurements for an exemplary embodiment of the lens of the present invention.

An automated scanning process as shown in FIG. 20 was used to acquire hydrophone amplitude measurements of the exemplary embodiment of the lens in this example. The aluminum and steel structure 100 supports the source 101 and the lens 102 (i.e., GRIN lens, gradient index lens) with a separation distance of approximately 1 cm. A hydraulic column 103 holds the structure at a constant depth of 0.685 m referenced to the vertical centerline of the source 101 and lens 102. The distance between the sound source 101 and the lens 102 is exaggerated in FIG. 20. Three stepper motors controlled by MATLAB via an Arduino Uno moved a rod with a RESON TC4013 Hydrophone 104 attached to the end through a rectangular area in front of the lens 102. The scan area was collinear with the center-line plane of the source 101 and the lens 102 at a depth of 685 mm. The area was 31.0 cm parallel to the lens 102 face by 20.0 cm perpendicular to the lens 102 face. The step size was set to 5 mm which resulted in 2,583 data points. As the hydrophone moved to each location, a pause of 2 seconds was initiated by the MATLAB program to negate rod dynamics due to the swaying caused by the scanner motion in the water. Voltage outputs were acquired from the oscilloscope and stored in an excel spreadsheet labeled for its exact location in the scan area. After each point had voltage data, the scanning program terminated after approximated 4.5 hours of run time. This process was completed with both the lens 102 and the source 101, and another case with just the source 101. This would allow the effects due to the inclusion of the lens 102 to be quantified by comparing the amplitude changes between the source only case and the source-lens case.

Figure 21:
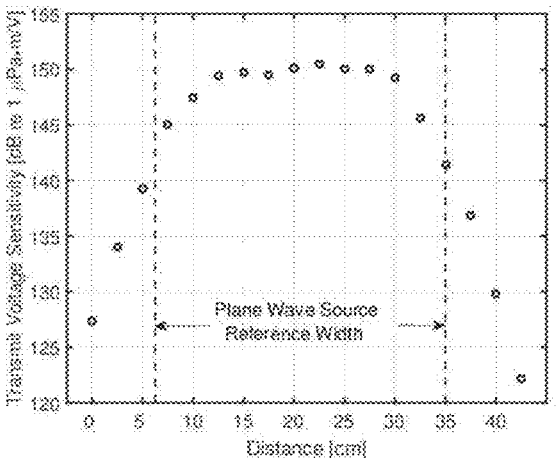
FIG. 21 shows planarity verification of a sound source, with the transmit voltage response (TVR) determined at evenly spaced locations at a constant distance of 9.5 cm from the sound source face. The source reference width is noted by the vertical dotted lines.

To begin simulation verification, a source 101 capable of generating constant amplitude acoustic waves was constructed and tested. The source 101 was 29.5 cm in width, 22.9 cm in height, and 6.4 cm in depth. The planarity was verified by submerging the source 101 at a depth of 68.5 cm measured from centerline and measuring pressure amplitude using an omni-directional hydrophone 104. The test signal was prescribed to be a sinusoidal pulse at a frequency of 35 kHz and amplitude of 2 Volts peak-to-peak for 15 cycles continuously repeating every 100 ms. The Hilbert transform was taken of the hydrophone measurement and the mean amplitude of the Hilbert transform was calculated for the steady state region of the signal. The transmit voltage response (TVR) of a transducer is the amount of sound pressure produced per volt applied and is calculated using $$TVR = 20\log_{10}\left(\frac{V_{out}R_{meas}}{V_{in}R_{ref}}\right) - RVS_{cal}, \tag{9}$$

wherein $V_{out}$ is the output voltage from the hydrophone 104, $V_{in}$ is the voltage applied to the transducer, $R_{meas}$ is the separation distance between the transducer and the hydrophone 104, $R_{ref}$ is the reference distance set to 1 m, and RVScal is the receive sensitivity of the calibrated hydrophone 104 taken from the hydrophone documentation. The Rmeas distance was set to 9.5 cm, $V_{in}$ was 2 Vpp, and RVScal was 211 dB/μPa. The planarity amplitude test results are shown in FIG. 21. The amplitude measurements show that there is relatively consistent planarity across the aperture of the source 101 face. However, as the boundaries of the source 101 are reached, the amplitude reduces by approximately 7 dB. Even though the amplitude decreases, the source 101 operates effectively enough to be used to verify the lens 102 simulations. It should be noted that source planarity may be a cause for a reduction in amplitude shown in this example because the width of the lens 102 extends outside the borders of the width of the source 101.

For both the source-only case and the source-lens case, the cross-correlation between the input signal and the voltage output from the hydrophone 104 was determined. A Hann window was applied to the cross-correlation over the direct path from the source 101. This removed any reflections from the water surface of the tank 105 or diffraction from the source 101 interaction with the edges of the lens 102 from contaminating the results. An example of this process is shown in FIGS. 22A-22C. The Fourier transform of the cross-correlation for both cases was then found. The gain was then calculated by means of Eq. 10, $$G = 20\log_{10}\left(\frac{X_{lenswin}}{X_{sourcewin}}\right) \tag{10}$$

wherein G is the gain at a particular scan point and frequency, $X_{lenswin}$ is the windowed cross-correlation from the source-lens case, and $X_{sourcewin}$ is the windowed cross-correlation from the source-only case.

As discussed above, the gain was measured by finding the amplitude difference between the source-only and the source-lens cases. The measurements at frequencies ranging from 20 to 45 kHz are shown in FIGS. 23A-23F. The amplitude scale represents the gain at each hydrophone 104 location in decibels. The general shape of the beam pattern shows a clear focusing tendency of the lens 102, especially in the 30 to 40 kHz range. This data shows evidence of a focused beam pattern forming at 20 kHz with approximately −5 dB of gain at the focus. As the frequency increases, the beam becomes narrower and the gain increases to peak levels at 30 kHz (FIG. 23C) and 35 kHz (FIG. 23D). There is also evidence that a stop band is approached as the frequency approaches 45 kHz (FIG. 23F). FIG. 24 shows the beam pattern of the normalized intensity through the focus for 35 kHz. Significant side lobe amplitude reduction is evident, and the beam width is 0.44λ with the speed of sound in fresh water assumed to be 1480 m/s.

The maximum gain through the frequency range was determined to be at 33.5 kHz as shown in FIG. 25A and FIG. 25B. To better quantify the data, a cross section of the amplitude data was extracted from FIG. 25A for a constant distance from the lens through the peak gain of focus. The maximum gain was observed to be 4.0 dB and the beam pattern was found to have 12 dB of sidelobe amplitude reduction compared to the focus as shown in FIG. 25B.

The as-designed and as-tested lenses of this example both work over a broad range of frequencies. FIGS. 16A-16F and FIGS. 23A-23F both show that the focal point moves toward the lens with the increase of frequency as predicted from the band diagram. It is also evident that the side lobe suppression ability of the lens in both simulation and actual use agree to a remarkable degree as can be seen from FIGS. 17 and 24, where the magnitude of the intensity of the side lobes are all lower than 1/10 of the maximum magnitude at the focal point.

The acoustic waves in the exterior water background are fully coupled to the structural waves inside the lens 102 so that the lens is backscattering free and is capable of focusing sound as predicted. The GRIN lens 102 is experimentally demonstrated to be capable of focusing underwater sound with high efficiency from 25 kHz to 40 kHz.

It is noted that the power magnification at the focal point have certain differences between simulations and actual use. These discrepancies are mainly due to the fabrication of the lens as explained below.

Potential error in this example was noted as data was taken. First, the source 101 itself had acceptable planarity, but as shown in FIG. 21, there is amplitude reduction at the edges of the source 101. This results in the outside portions of the lens 102 to have less contribution to the focusing beam pattern than was assumed in the simulation. The lens 102 pieces themselves have a machining tolerance that also affects the mass and stiffness properties of the architecture. With an effectively random distribution of tolerances throughout the assembled lens 102, the altered effective index distribution may cause some variability in the focal distance.

During the scanning process, the hydrophone rod 104 moved from location to location to acquire data. In order to protect the scanning components, the scanner 106 could not be submerged underwater, but the depth of the lens 102 and source 101 were desired to be at the greatest depth possible to eliminate contamination by reflections from the water surface. However, this resulted in the hydrophone rod 104 to have a length longer than the depth of the lens 102 with a single attachment point at its extreme. As the location changed, the resistance of the water caused the lens 102 to sway momentarily during the beginning of each measurement potentially affecting the results.

The lens 102 construction also includes the rubber gaskets 260 between each plate 250 of the lens 102. In this example, some excess rubber was necessary to extend over the perimeters of each lens plate 250 to ensure a watertight seal. However, this excess rubber results in an impedance mismatch between the lens face and the surrounding water. This causes a reflection of wave energy at both the front and back faces of the lens 102 and inevitably causes a reduction of energy that should reach the focus. The surface impedance mismatch induced by the alternating layers of plates 250 and rubber gaskets 260 causes a lower gain than expected. Moreover, the impedance mismatch could cause focal distance shift even though the index distribution still follows the modified secant index profile.

Although not wishing to be bound my any particular theory, it is believed that these sources of error support the observed differences between the simulation and the actual use with the most noticeable being the lower gain obtained via the actual use. There is a 5 dB deficit from the simulations, which can likely be attributed to the excess rubber causing an impedance mismatch.

In addition, the physics behind the GRIN lens 102 makes it possible to focus sound at both steady state and transient domain. The mismatch of the focal distance in simulation and in actual use is due to the accuracy of the waterjet machining process and the assembly method as described above. This issue could be successfully resolved by using more advanced fabrication methods such as wire EDM or 3D metal printing. The design method of the lens can also be easily extended to the design of anisotropic metamaterials such as directional screens and acoustic cloaks.

The present lens design has potential applications in medical ultrasound imaging and underwater sensing where the water environment is important, such as underwater acoustic communications.

The foregoing example and description should be taken as illustrating, rather than limiting, the present invention as defined by the claims. As will be readily appreciated, numerous variations and combinations of the features set forth above can be utilized without departing from the present invention as set forth in the claims. Such variations are not regarded as a departure from the spirit and scope of the invention, and all such variations are intended to be included within the scope of the following claims.

All references cited herein are incorporated by reference herein in their entireties.

The invention claimed is:

1. A metal acoustic lens comprising a plurality of stacked plates and cover plates on the top and bottom of the plurality of stacked plates, wherein each stacked plate comprises an acoustically transparent two-dimensional material structure comprising:

a plurality of adjacent hexagonal cells, wherein each hexagonal cell includes six members which form the sides of the hexagonal cell, and a plurality of lobes extending inwardly from the vertices of the hexagonal cell; and wherein the lengths and widths of the lobes vary across each stacked plate in the longitudinal direction and the lengths and widths of the members vary across each stacked plate in the longitudinal direction such that the density and the speed of sound waves passing therethrough are varied simultaneously while an acoustic impedance of the acoustic lens is kept constant and the resulting sound is focused.

2. The metal acoustic lens according to claim 1, wherein the plurality of adjacent hexagonal cells has an acoustic impedance that is equal to the acoustic impedance for water.

3. The metal acoustic lens according to claim 2, wherein the plurality of adjacent hexagonal cells are transversely isotropic; and wherein the lens has an index of refraction gradient that follows a modified hyperbolic secant profile, and the index of refraction values within the lens is in the range of 0.5 to 1.0.

4. The metal acoustic lens according to claim 1, wherein the lens is operable at frequencies from 25 to 40 kHz.

5. A plate comprising an acoustically transparent two-dimensional material structure, the acoustically transparent two-dimensional material structure comprising:

a plurality of adjacent hexagonal cells, wherein each hexagonal cell includes six members which form the sides of the hexagonal cell, and a plurality of lobes extending inwardly from the vertices of the hexagonal cell;

wherein the lengths and widths of the lobes vary across each plate in the longitudinal direction and the lengths and widths of the members vary across each plate in the longitudinal direction such that the density and the speed of sound waves passing therethrough are varied simultaneously while an acoustic impedance of the acoustic lens is kept constant and the resulting sound is focused.

6. The plate according to claim 5, wherein the plurality of adjacent hexagonal cells have an acoustic impedance that is equal to the acoustic impedance for water.

7. The plate according to claim 6, wherein the plurality of adjacent hexagonal cells are transversely isotropic.

8. A method of manufacturing a plate comprising an acoustically transparent two-dimensional material structure, the method comprising:

machining out of a solid piece of metal a plurality of adjacent hexagonal cells, wherein each hexagonal cell includes six members which form the sides of the hexagonal cell, and a plurality of lobes extending inwardly from the vertices of the hexagonal cell; and wherein the lengths and widths of the lobes vary across each plate in the longitudinal direction and the lengths and widths of the members vary across each plate in the longitudinal direction such that the density and the speed of sound waves passing therethrough are varied simultaneously while acoustic impedance of the acoustic lens is kept constant and the resulting sound is focused.

9. The method of manufacturing a plate according to claim 8, wherein the plurality of adjacent hexagonal cells has an acoustic impedance that is equal to the acoustic impedance for water.

10. The method of manufacturing a plate according to claim 9, wherein the plurality of adjacent hexagonal cells are transversely isotropic.

11. A method of manufacturing a metal acoustic lens, the method comprising:

manufacturing a plurality of plates according to the method of claim 8;

stacking the plurality of plates on top of each other, and including a gasket placed between each pair of plates;

affixing cover plates on the top and bottom of the stack of the plurality of plates; and aligning the stack of the plurality of plates by inserting a plurality of rods through the stack of the plurality of plates.

12. The method of manufacturing a metal acoustic lens according to claim 11, wherein the plurality of adjacent hexagonal cells has an acoustic impedance that is equal to the acoustic impedance for water.

13. The method of manufacturing a metal acoustic lens according to claim 12, wherein the plurality of adjacent hexagonal cells are transversely isotropic; and wherein the lens has an index of refraction gradient that follows a modified hyperbolic secant profile, and the index of refraction values within the lens is in the range of 0.5 to 1.0.

14. The method of manufacturing a metal acoustic lens according to claim 11, wherein the lens is operable at frequencies from 25 to 40 kHz.

15. The metal acoustic lens of claim 1, wherein the plurality of stacked plates comprises stacked plates having the same design.

16. The metal acoustic lens of claim 1, wherein the plurality of stacked plates comprises two to twenty stacked plates.

17. The metal acoustic lens of claim 1, wherein the metal acoustic lens comprises an interior sealed from exterior water.

18. The metal acoustic lens of claim 1, wherein the plurality of stacked plates comprises a stacked plate fabricated of aluminum, steel, tin, lead, or brass.

* * * * *